United States Patent [19]

Takemasa et al.

[11] Patent Number: 4,745,788

[45] Date of Patent: May 24, 1988

[54] ROLL REARRANGING APPARATUS

[75] Inventors: Toshihiro Takemasa; Nobuyuki Taniguchi, both of Hiroshima; Hiroyasu Yuasa; Namio Suganuma, both of Kurashiki, all of Japan

[73] Assignees: Mitsubishi Jukogyo Kabushiki Kaisha; Kawasaki Steel Corporation, both of Japan

[21] Appl. No.: 914,621

[22] Filed: Oct. 2, 1986

[30] Foreign Application Priority Data

Oct. 7, 1985 [JP] Japan ..... 60-221925

[51] Int. Cl.[4] ..... B21D 1/02; B21B 31/10

[52] U.S. Cl. ..... 72/160; 72/205; 72/239

[58] Field of Search ..... 72/160, 164, 165, 239, 72/238, 205

[56] References Cited

U.S. PATENT DOCUMENTS

| | | | |
|---|---|---|---|
| 3,555,871 | 1/1971 | Hlafcsak | 72/239 |
| 3,589,161 | 6/1971 | Moffett | 72/238 |
| 3,698,226 | 10/1972 | Eibe | 72/239 |
| 3,864,954 | 2/1975 | Eibe et al. | 72/239 |

FOREIGN PATENT DOCUMENTS

| | | | |
|---|---|---|---|
| 2027350 | 12/1971 | Fed. Rep. of Germany | 72/238 |
| 104218 | 6/1984 | Japan | 72/160 |
| 2118468 | 11/1983 | United Kingdom | 72/239 |

*Primary Examiner*—Daniel C. Crane

*Attorney, Agent, or Firm*—McGlew and Tuttle

[57] ABSTRACT

A roll rearranging apparatus is so constructed that an upper roll unit of a tension leveler can be taken in and out together with a lower roll group from a housing. In order to greatly reduce the rearranging time and improve the production efficiency by reduction of labor and the safety of work, the apparatus comprises an arm which is provided at a work side end of a roll support supporting a roll unit, the arm including a hole at a lower side thereof, and an engagement capable of being engaged with the hole of the arm and including a moving up and down mechanism.

8 Claims, 5 Drawing Sheets

ROLL REARRANGING APPARATUS

BACKGROUND OF THE INVENTION

1. Field of the Invention

The present invention relates to an improvement of a roll rearranging apparatus of a tension leveler, and more particularly to a roll rearranging apparatus which can be also applied to a scale breaker.

2. Description of the Related Art

Since a long, narrow strip of plate material (hereinafter referred to as strip) such as cold-rolled steel material is given defect in form such as warp or partial extension on the surface thereof in the process of rolling, a tension leveler is usually used to correct the defect.

An example of the tension leveler is now described with reference to FIGS. 3 to 6. As shown in the figures, the tension leveler is to extend a strip 53 and correct the shape thereof by bending the strip 53 by means of a leveling mill (hereinafter referred to as a leveler) 54 composed of a multiplicity of small rolls while giving tension to the strip 53 by input and output bridles 51 and 52. That is, the leveler 54 includes work roll units 55, 56 and 57, a deflector roll units 58 and 59 and a deflector roll unit 60 composed of a pair of rolls which are disposed above and below the strip 53 in staggered manner to put the strip 53 therebetween. The work roll unit 56 and the deflector roll units 58 and 60 disposed above the strip 53 are supported at both ends thereof by roll supports 56*a*, 58*a* and 60*a*, respectively. The roll supports 56*a*, 58*a* and 60*a* move up and down along guide grooves 61*a*, 61*b* and 61*c* of a housing 61 by pairs of cylinders 62, 63 and 64 disposed in a work side W and a drive side D in an upper portion of the housing 61, respectively, and are mounted to be capable of being fixed at the bottom of the grooves. Further, there are provided wheels 65 at both sides of one end of the roll supports 56*a*, 58*a* and 60*a* in the axial direction of the roll in the drive side D, and rails 66, 67 and 68 which receive and guide the wheels 65 are disposed in the housing 61 in the axial direction of the roll. Accordingly, the roll supports 56*a*, 58*a* and 60*a* move horizontally in the axial direction a of the roll shown by arrow of FIG. 4 along the rails 66, 67 and 68, respectively, so that the roll supports can be taken out from the housing 61 to the work side W and taken in the housing 61. Further, since there are provided stoppers 71 at an end of the rails 66, 67 and 68 at the work side W as shown in FIG. 4, the rolls and the roll supports are extended or taken out from the housing 61 properly and can be hung up by a crane or the like smoothly.

On the other hand, the work roll units 55 and 57 disposed below the strip 53 are supported at both ends thereof by roll supports 55*a* and 57*a*, respectively. The roll supports 55*a* and 57*a* are mounted to be capable of moving only in the up and down directions along a guide groove 70*a* of a lower frame 70 and are supported by intermesh adjustment devices 72 and 73 such as a screwed jack driven by a motor disposed in the bottom of the lower frame 70. The deflector roll 59 is directly mounted to the lower frame 70. The lower frame 70 is supported by a pair of cylinders 74 disposed at the work side W and the drive side D to be able to move up and down in the housing 61 and is adapted to be able to be fixed to a lower surface of a protrusion 61*d* disposed in the center of the housing. Further, the lower frame 70 is provided with four wheels 75 which are put on rails 76 and 78. The rails 76 and 78 are disposed on a base 77 at the work side W in the lower portion of the housing 61. The lower frame 70 can be moved on the rails 76 and 78 horizontally in the axial direction a of the roll by being pushed by a transportation cylinder 79.

Further, there is provided a roll rearranging device which can take out from the housing 61 and take in the housing 61 the upper roll units 56, 58 and 60 together with the lower roll unit groups 55, 57 and 59. That is, an arm 69 is horizontally projected at end of the upper roll supports 56*a*, 58*a* and 60*a* at the work side W and the arm 69 is formed with a groove 69*a*. A support 82 is disposed at the work side W of the lower frame 70 with the support being projected horizontally from the lower frame and then bending upward. A pair of brackets 80 is mounted on an upper end of the support 82. Pin holes 80*a* are formed in the pair of brackets 80 as shown in FIGS. 5 and 6. A support pin 81 is inserted into the pin holes 80*a* horizontally and can be secured with a nut 81*a*. Accordingly, as shown in FIG. 5, when the support 82 and the brackets 80 are moved upward with regard to the arm 69, the support pin 81 mounted between the pin holes 80*a* is fitted into the grooves 69*a* of the arm 69. The height of the support 82 is determined so that the support pins 81 of the brackets 80 can be fitted into the groove 69*a* formed at the lower side of the end of the arm 69 and can support the upper roll supports 56*a*, 58*a* and 60*a* when the upper roll supports 56*a*, 58*a* and 60*a* and the lower frame 70 are put on the rails 66, 67, 68 and 76 of the housing 61, respectively. The distance between the brackets 80 is selected so that the arm 69 can move up and down between the brackets 80 without restraint when the support pin 81 is pulled out from the pin holes 80*a* in the operating condition where the upper roll unit 56*a*, 58*a* and 60*a* and the lower frame 70 are fixed to the housing 61. In the figure, numeral 88 denotes a keeper plate detachably mounted for preventing the lower frame 70 from moving in the axial direction of the roll with regard to the housing 61.

With the above structure, in the roll rearranging operation, the lower cylinder 74 of the housing 61 is shortened to move down the lower frame 70. After the lower frame 70 is thus put on the rail 76, the support pin 81 is manually mounted to the bracket 80 of the support 82 which is engaged with a desired upper roll unit requiring the rearrangement, for example, the work roll unit 56. Then, when the cylinder 62 for the work roll unit 56 is extended to move down the roll support 56*a*, the roll support 56*a* is horizontally supported to the support 82 and the rail 66 through the arm 69 and the support pin 81 and the wheel 65, respectively. Subsequently, when the moving cylinder 79 is moved forward after opening the keeper plate 83 of the housing 61 at the work side W, the work roll unit 56*a* is moved to the work side W together with the lower frame 70 while engaged with the support pin 81 of the support 82. The cylinder 79 is stopped at the position where the wheel 65 of the roll support 56*a* abuts against the stopper 71. Thereafter, exchange of an used roll for with a new roll, repair work for damaged rolls or the like is made in accordance with rearrangement procedure well-known heretofore and then by performing the reverse procedure to the above procedure the rearrangement works are finished.

PROBLEMS THAT THE INVENTION IS TO SOLVE

However, since the support pin 81 is manually fitted into and removed from the support 82 each time the roll unit is taken in and out from the housing 61 in the above apparatus, a great deal of time and labor are required for the rearrangement work and hence it is not desirable in view of reduction of production efficiency due to stoppage of operation and safety of an operator.

SUMMARY OF THE INVENTION

It is an object of the present invention to provide a roll rearranging apparatus for a tension leveler which can attain reduction of roll rearranging time and labor by automatizing the coupling work of the upper roll support and the lower frame when a roll unit is taken in and out from a housing in roll rearrangement.

More particularly, an object of the present invention is to provide a roll rearranging apparatus in which, when the roll unit is taken in and out from the housing toward a work side, an upper roll unit can attain automatic engagement by means of an arm provided in each of roll supports and engaging means including a moving up and down provided in a lower frame and the upper roll unit requiring the rearrangement can be taken in and out toward the work side together with a lower frame.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE INVENTION

An embodiment of the present invention is now described in detail with reference to the drawings.

Figure 1:
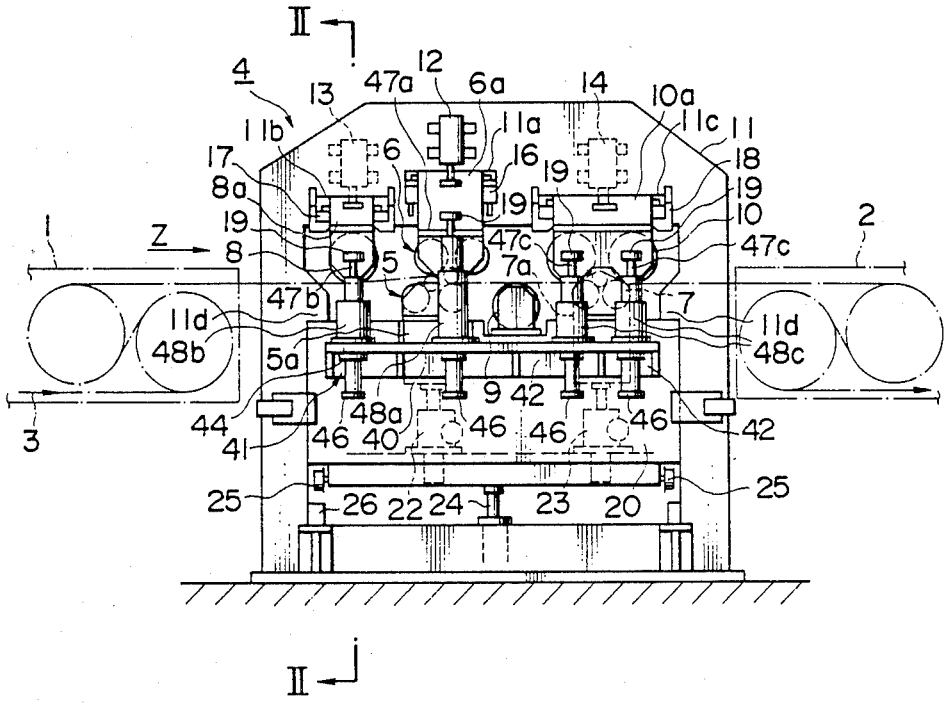
FIG. 1 is an overall front view of a tension leveler provided with a roll rearranging apparatus according to an embodiment of the present invention.
Figure 2:
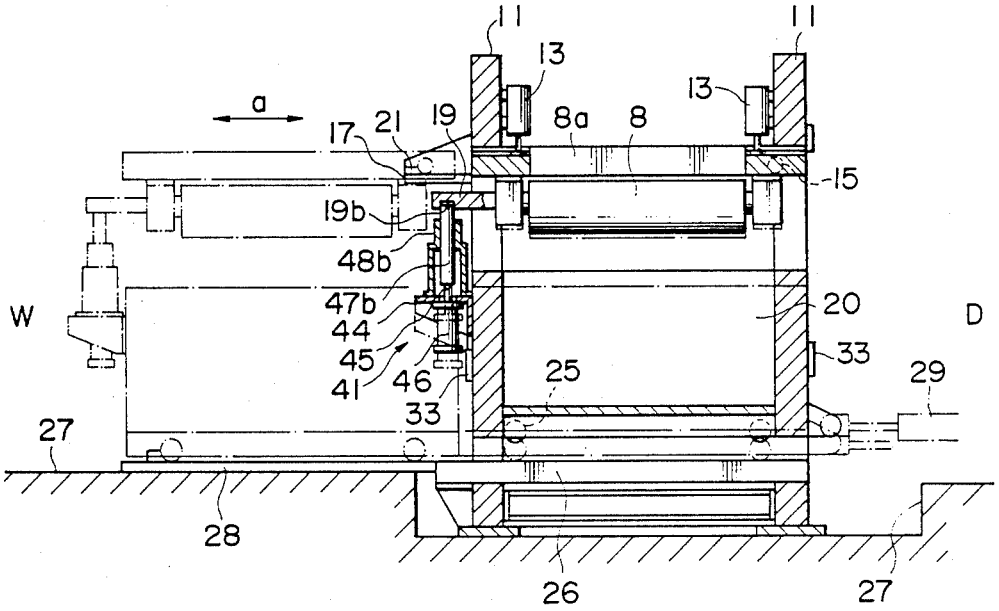
FIG. 2 is a sectional view taken along line II—II of FIG. 1.
Figure 3:
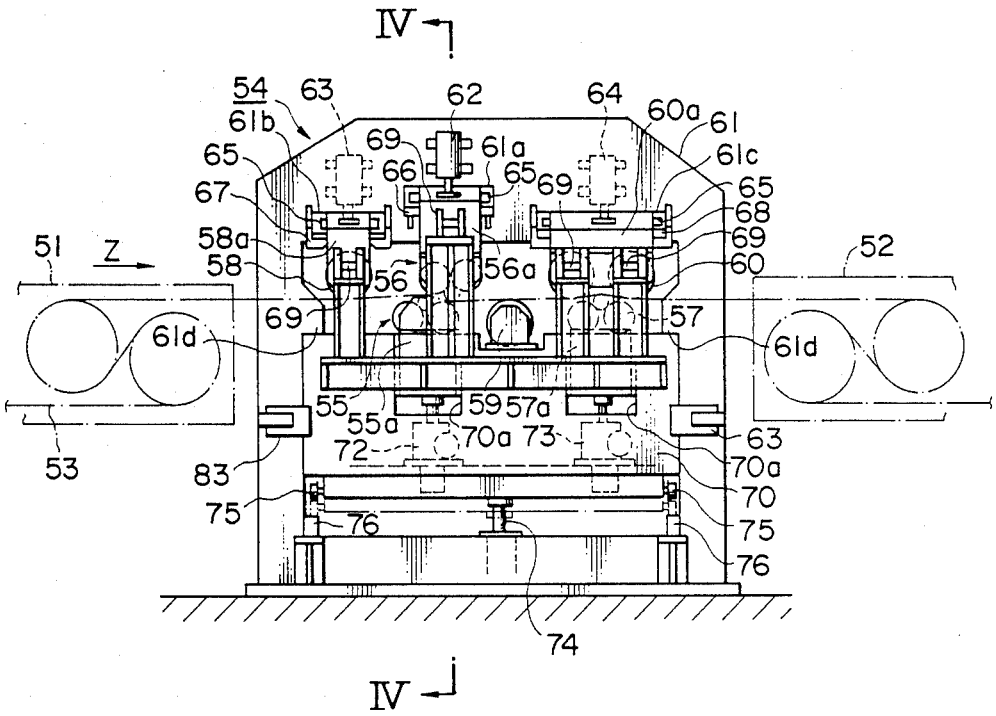
FIG. 3 (PRIOR ART)
FIG. 3 is a front view of a prior art tension leveler.
Figure 4:
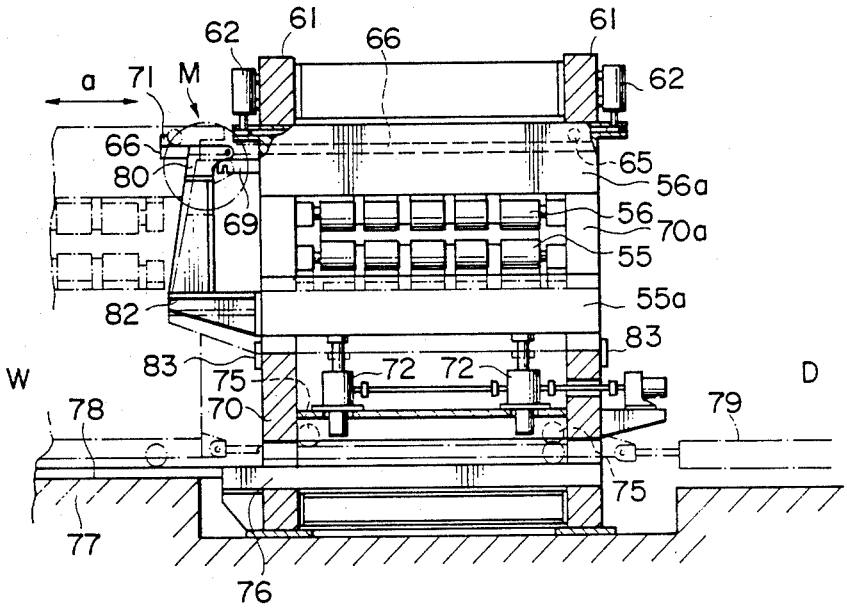
FIG. 4 (PRIOR ART)
FIG. 4 is a sectional view taken along line IV—IV of FIG. 3.
Figure 5:
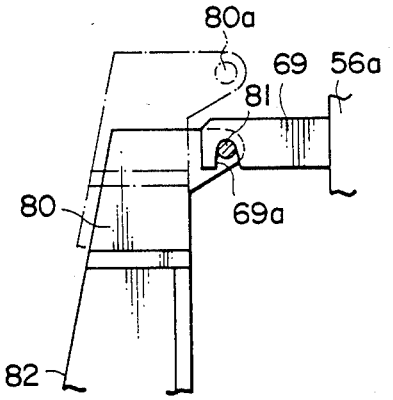
FIG. 5 (PRIOR ART)
FIG. 5 is an enlarged view of an M portion enclosed by single-dotted broken line in FIG. 4.
Figure 6:
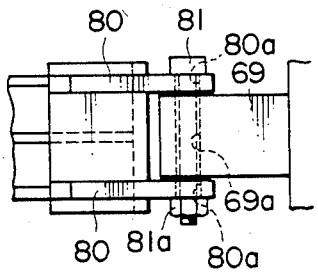
FIG. 6 (PRIOR ART)
FIG. 6 is a plan view of the M portion of FIG. 5.

FIG. 1 shows an overall front view of a tension leveler accoring to the embodiment as viewed from a work side and FIG. 2 shows a sectional view taken along line II—II of FIG. 1. As shown in both the figures, the tension leveler is to extend a strip 3 and correct the shape thereof by bending the strip by means of a leveling mill (hereinafter referred to as a leveler) 4 composed of a multiplicity of small rolls while giving tension to the strip 3 by input and output bridles 1 and 2. More particularly, the leveler 4 comprises work roll units 5, 6 and 7, deflector roll units 8 and 9 and a deflector roll unit 10 composed of a pair of rolls which are disposed above and below the strip 3 in staggered manner to put the strip 3 therebetween. The work roll unit 6 and the deflector roll unit 8 and 10 disposed above the strip 3 are supported at the both ends thereof by roll supports 6*a*, 8*a* and 10*a*, respectively. The roll supports 6*a*, 8*a* and 10*a* move up and down along guide grooves 11*a*, 11*b* and 11*c* of a housing 11 by pairs of cylinders 12, 13 and 14 disposed at the work side W and the drive side D in the upper portion of the housing 11, respectively, and are mounted to be able to be fixed to the bottom of the grooves. Further, there are provided wheels 15 at both sides of the drive side D in one end of the roll supports 6*a*, 8*a* and 10*a* in the axial direction of the roll, and rails 16, 17 and 18 which receive and guide the wheels 15 are disposed in the housing 11 in the axial direction of the roll. Accordingly, the roll supports 6*a*, 8*a* and 10*a* move horizontally in the axial direction a of the roll shown by arrow of FIG. 2 along the rails 16, 17 and 18, respectively, so that the roll supports can be taken out from the housing 11 to the work side W and taken in the housing 11. Further, since there are provided stoppers 21 at an end of the rails 16, 17 and 18 at the work side W as shown in FIG. 2, the rolls and the roll supports are extended or taken out from the housing 11 properly and can be hung up by a crane or the like smoothly.

On the other hand, the work roll units 5 and 7 disposed below the strip 3 are supported at both ends thereof by roll supports 5*a* and 7*a*, respectively. The roll supports 5*a* and 7*a* are mounted to be capable of moving only in the up and down directions along a guide groove of a lower frame 20 and are supported by intermesh adjustment devices 22 and 23 such as a screwed jack driven by a motor disposed in the bottom of the lower frame 20. The deflector roll 9 is directly mounted to the lower frame 20. The lower frame 20 is supported by a pair of cylinders 24 disposed at the work side W and the drive side D to be able to move up and down in the housing 11 and is adapted to be able to be fixed to a lower surface of a protrusion 11*d* disposed in the center of the housing. Further, the lower frame 20 is provided with four wheels 25 which are put on rails 26 and 28. The rails 26 and 28 are disposed on a base 27 at the work side W in the lower portion of the housing 11. The lower frame 20 can be moved on the rails 26 and 22 horizontally in the axial direction a of the roll by being pushed by a transportation cylinder 29.

Further, there is provided a roll rearranging device which can take out from the housing 11 and take in the housing 11 the upper roll units 6, 8 and 10 together with the lower roll unit groups 5, 7 and 9. That is, the roll rearranging apparatus of the present invention comprises an arm 19 disposed at the work side W of the roll supports 6*a*, 8*a* and 10*a* disposed above the strip 3 and stoppers 40, 41, and 42 disposed in the lower frame 20 and forming, for example, engaging means which can be engaged with hole 19*b* of the arm 19 and which includes a moving up and down mechanism. A support base 44 is mounted to a side of the lower frame 20 at the work side W and the support base 44 is provided with a plurality of hydraulic cylinders 46 located just below the arms 19. Each of the hydrauric cylinders 46 is provided with a rod 45 which is projected upward. Upper ends of the rods 45 are coupled with stopper rods 47*a*, 47*b*, 47*c* and 47*c*, respectively. Guide cylinders 48*a*, 48*b*, 48*c* and 48*c* which guide the stopper rods 47*a*, 47*b*, 47*c* and 47*c* slidably, respectively, are mounted on the support base 44. An upper end of the stopper rods 47*a*, 47*b*, 47*c* and 47*c* can be detachably engaged with the hole 19*b* formed in the middle of the lower side of the end of the arm 19 of the upper roll supports 6*a*, 8*a* and 10*a*, respectively. Accordingly, as shown by a single-dotted broken line of FIG. 2, in the condition where the lower frame 20 is put on the rail 26 disposed at the lower part of the housing 20 and the upper roll support 8*a* is put on the rail 17 disposed at the upper part of the housing 11, when the rod 45 is projected from the hydrauric cylinder 46 to lift up the stopper rod 47*b*, the upper end of the stopper rod 47*b* is engaged with the hole 19*b* of the arm 19 at the stroke end of the stopper rod 47*b* and the roll support 8*a* is supported on the rail 17 horizontally. On the other hand, in the operation condition where the apparatus is set as shown by solid line of FIGS. 1 and 2, when the rod 45 goes down until the stroke end thereof by means of the hydrauric cylinder 46, little space is formed between the upper end of the stopper rod 47*b* and the bottom of the hole 19*b* of the arm 19 so that there is not any difficulty in the intermesh establishment. The other stopper rods 47*a* and 47*c* are the same as the above.

In FIGS. 1 and 2, numeral 33 denotes a keeper plate which is disposed detachably to prevent the lower frame 20 from moving in the axial direction of the roll with regard to the housing 11 and Z indicates the moving direction of the strip 3.

Wtih the above structure, the roll rearrangement by the roll rearranging apparatus of the embodiment is performed as follows.

First of all, the cylinder 24 is shortened to lower down the lower frame 20 and the lower frame 20 is put on the the rail 26 in the lower part of the housing 11 in the conventional procedure. The cylinder 46 for the stopper 41 disposed at the side of the upper roll unit 8, for example, to be rearranged is extended to lift up the stopper rod 47*b* until the stroke end thereof. Thereafter, when the cylinder 13 is extended to lower down the roll unit 8 and the roll support 8*a*, the wheel 15 is put on the rail 17 and the upper end of the stopper rod 47*b* is engaged with the hole 19*b* of the arm 19 so that the roll unit 8 and the roll support 8*a* are supported horizontally. In this condition, the roll unit 8 and the roll support 8*a* can move horizontally along the rail 17 as shown by arrow a of FIG. 2 and are restrained from movement to the lower frame 20 in the direction of arrow a of FIG. 2. Then, when the moving cylinder 29 is extended to move the lower frame 20 in the axial direction of the roll, that is, in the direction of arrow a of FIG. 2 in the same procedure as in the conventional apparatus, the roll unit 8 moves in the same direction at the same time. Thus, the upper and lower roll units are taken out from the housing 11 and old rolls are exchanged with new rolls.

As described above, in the present invention, when the upper and lower roll units are taken in and out from the housing in order to rearrange the rolls, the engaging means including the moving up and down mechanism such as the cylinder drive can be used to fixedly support the upper roll supports to the lower frame automatically and hence much reduction of the rearranging time and improvement of the production efficiency by reduction of labor and safety of operation can be attained as compared with the conventional rearranging apparatus.

Although start and stop of the cylinders 13 or 12, 14, 24, 46 and 29 in the roll rearranging procedure are eliminated in the figures, automatic operation therefor can be made by well-known control means.

In the above embodiment, while the hydraulic cylinder 46 is used as the moving up and down mechanism for the stoppers 40, 41 and 42, it is not limited thereto but a screwed jack driven by a motor may be used.

While a specific embodiment of the invention has been shown and described in detail to illustrate the application of the principles of the invention, it will be understood that the invention may be embodied otherwise without departing from such principles.

What is claimed is:

1. A tension leveler comprising: a tension leveler housing; a first upper roll unit including at least one first upper roll unit roll adapted to rotate about a central axis, a roll support for supporting said at least one roll, at least one rail supported by said housing and wheels connected to said roll support engaging said at least one rail to allow said first upper roll unit to be movable relative to said housing in an axial direction with respect to said at least one first upper roll unit roll; at least one second upper roll unit including at least one second upper roll unit roll adapted to rotate about a central axis, a roll support for supporting said at least one second upper roll unit roll, at least one second upper roll unit rail supported by said housing and second upper roll unit wheels connected to said second upper roll unit roll support engaging said at least one second upper roll unit rail to allow said second upper roll unit to be movable relative to said housing in an axial direction with respect to said at least one second upper roll unit roll; a lower roll unit supported in a lower frame, said frame including a plurality of lower wheels, at least one lower rail adapted to receive said rails said lower frame being disposed in said housing, at least one lower roll adapted to rotate about an axis, said lower frame being movable in an axial direction with respect to said at least one lower roll; and engaging means, connected to said lower roll unit, for engaging the roll support of said first upper roll unit and said second upper roll unit so as to selectively provide for removing the lower roll unit and one of said first upper roll unit and said at least one second upper roll unit and both the first upper roll unit and said at least one second upper roll unit, said engaging means includes a hole portion provided in each of said first upper roll unit roll support and said at least one second upper roll unit roll support, and a plurality of up and down moving mechanisms movable relative to said lower frame to engage a corresponding hole in the first upper roll unit roll support and at the least one second upper roll unit roll support.

2. A tension leveler according to claim 1 further comprising: a plurality of upper cylinders adapted to move each of the upper roll units in an up and down direction; a plurality of cylinders adapted to move said lower roll unit in an up and down direction, said hole being engaged with said engaging means and each of said roll units being supported by corresponding rails when said roll units are lowered into a down position, thereby allowing said upper and lower roll units to be moved together on rails.

3. A tension leveler according to claim 1 further comprising: a stop formed at the end of at least one of said rails so as to limit movement of said roll units as the units move in an axial direction.

4. A tension leveler according to claim 1 wherein said engaging means comprises one of a cylinder and a screwed jack driven by a motor.

5. A roll rearranging apparatus comprising: a housing; a plurality of upper roll units, each roll unit including at least one upper roll adapted to rotate about a central axis, an upper roll support for supporting said at least one roll, at least one upper rail supported by said housing and upper wheels connected to said roll support engaging said at least one rail to allow each of the plurality of upper roll units to be movable relative to said housing in an axial direction with respect to said upper roll; a lower roll unit supported in a lower frame, said frame including a plurality of lower wheels, at least one lower rail disposed in said housing, at least one lower roll adapted to rotate about an axis, said lower frame being movable in an axial direction with respect to at least one lower roll; and, engaging means for selectively engaging each of the roll supports of the plurality of upper roll units, thereby allowing the removal of the lower roll unit and one or more of the plurality of upper roll units, each of said roll supports includes an arm disposed at an end of said roll support defining a hole at the lower side thereof, said engaging means including a plurality of separately up and down moving mechanisms, each mechanism being selectively engageable with one corresponding roll support arm hole.

6. A roll rearranging apparatus according to claim 5 further comprising: a plurality of upper cylinders adapted to selectively move each of the upper roll units in an up and down direction; a plurality of lower cylinders adapted to move said lower roll unit in an up and down direction, said roll support arm hole being engaged with said engaging means when one or more of said plurality of upper roll units and said lower roll unit are lowered down and supported on corresponding rails, so as to allow one or more of said upper roll units and said lower roll units to be moved together on said rails.

7. A roll rearranging apparatus according to claim 5 further comprising: a stopper formed at an end of at least one of said upper and lower rails so as to limit movement of one or more of said plurality of upper roll units and said lower roll units in an axial direction.

8. A roll rearranging apparatus according to claim 5 wherein: said engaging means includes one of a cylinder and a screwed jack driven by a motor.

* * * * *